US005649829A

United States Patent [19]

Miller et al.

[11] Patent Number: 5,649,829

[45] Date of Patent: Jul. 22, 1997

[54] LOW PROFILE DISTRIBUTION ADAPTER FOR USE WITH TWISTED PAIR CABLES

[76] Inventors: Mitchell Eugene Miller, 5344 Leesa Dr., Clemmons, N.C. 27012; Riley Keith Barker, Rte. 13 Box 2144, Lexington, N.C. 27292

[21] Appl. No.: 505,046

[22] Filed: Jul. 21, 1995

[51] Int. Cl.[6] ..... H01R 9/09

[52] U.S. Cl. ..... 439/76.1; 439/49

[58] Field of Search ..... 439/49, 50, 76.1, 439/638, 676

[56] References Cited

U.S. PATENT DOCUMENTS

| | | | |
|---|---|---|---|
| 3,771,101 | 11/1973 | Elkins . | |
| 4,213,013 | 7/1980 | Perna et al. | 439/49 X |
| 4,398,780 | 8/1983 | Novotny et al. . | |
| 4,595,799 | 6/1986 | Krob et al. | 179/98 |
| 4,749,370 | 6/1988 | Moser et al. | 439/460 |
| 4,767,338 | 8/1988 | Dennis et al. | 439/49 X |
| 4,773,867 | 9/1988 | Keller et al. | 439/49 |
| 4,894,024 | 1/1990 | Debortoli et al. | 439/535 |
| 5,130,893 | 7/1992 | Straate et al. | 439/49 X |
| 5,176,534 | 1/1993 | Nozick | 439/402 |
| 5,392,571 | 2/1995 | Greenfield | 52/105 |

OTHER PUBLICATIONS

AMP Incorporated Catalog, Support Products p.153 (Mar. 1995).

AMP Incorporated Customer Drawing 553150.

AMP Incorporated Customer Drawing 555488, (2 sheets) Dated Mar. 10, 1988.

AMP Customer Drawing 552118, Dated Nov. 5, 1979.

AMP Customer Drawing 556796, Dated Feb. 21, 1991.

AMP Customer Drawing 229912, Dated Aug. 21, 1986.

AMP Customer Drawing 553257, Dated Nov. 18, 1980.

AMP Customer Drawing 745414, Dated Jan. 4, 1984.

AMP Customer Drawing 553868, Dated Jun. 18, 1985.

AMP Customer Drawing, 553867, Dated Jun. 18, 1985.

AMP Customer Drawing, 229975, Dated Feb. 18, 1980.

AMP Customer Drawing, 558693, Dated Dec. 20, 1994.

AMP Customer Drawing 554753, Dated Jun. 6, 1985.

*Primary Examiner*—Khiem Nguyen

[57] ABSTRACT

A zone distribution adapter 2 for use as a breakout or tap with twisted pair cables provides a compact configuration that can be employed as a standalone component with a cover 22 enclosing a printed circuit board assembly, or the printed circuit board assembly can be mounted in standard distribution boxes or beneath a low profile access floor. The preferred embodiments of the zone adapter printed circuit board assembly includes a twenty-five pair vertical mount electrical connector 12 soldered to a printed circuit board 8 with four-pair electrical connectors, such as right angle modular jacks 16 or punchdown blocks 20 soldered on the sides of the twenty-five pair connector. Printed circuit board traces 10 connect corresponding positions in the twenty-five pair connector 12 and the four-pair connectors 16, 20. The cover 22 includes a central channel 26 between two raised side sections 28 with an opening 24 through which the mating portion 14 of the twenty-five pair connector extends. Twenty-five pair cable connectors 42 mated to the vertical mount printed circuit board connector 12 are thus positioned on the outside of the cover 22 so that the zone adapter retains a low profile which permitting the use of different cable connector configurations.

17 Claims, 4 Drawing Sheets

LOW PROFILE DISTRIBUTION ADAPTER FOR USE WITH TWISTED PAIR CABLES

BACKGROUND OF THE INVENTION

1. Field of the Invention

The distribution adapter disclosed herein is related to the distribution of signals in a telecommunications or a data network using twisted pair conductors. More particularly this adapter is intended to be used in connecting corresponding conductors in two twisted pair cables, such as twisted pairs in a twenty-five pair cable to a four-pair cable connected to an individual user station. More particularly, this invention is related to the interconnection of a cable including multiple conductors terminated to a multiposition connector such as a twenty-five pair (fifty position) miniature ribbon connector to standard connectors used with four-pair cable, such as modular jacks and punchdown blocks.

2. Description of the Prior Art

Twisted pair conductors are used to distribute signals in a wide variety of applications. The most common traditional use of twisted pair wires and cables is probably for the distribution of telephone signals where these cables are used for the distribution of POTS, analog voice and digital voice and these conductors are also used for ISDN communications. Four wire and six wire cables are commonly used in premise telephone systems to interconnect individual telephones and eight wire cables are used for ISDN applications. Twenty-five pair cables are used where it is necessary to run a large number of wire pairs between two points, for example to connect separate wiring closets in a commercial building. In such applications it is quite common to run twenty-five pair cables between wiring closets and then to connect smaller count cables between using patch panels in the wiring closets. Smaller count cables can then extend between the wiring closets and individual user equipment. Alternatively, twenty-five pair cables can extend from the wiring closets to distribution adapters where smaller count cables can be attached.

Twisted pair cables are also commonly used in local area networks for data communications. Different applications require different performance standards for the cable used in such applications and twisted pair cable classifications have been established for unshielded twisted pair cables by the Electronic Industries Association. For example, Category 1 cable are suitable for POTS, analog voice and digital voice. Category 2 is suitable for 1.44 Mbps ISDN and T1 while Category 3 is suitable for 10BASE-T. Categories 4 and 5 are intended for higher speed applications. For example Category 5 is intended for data rates on the order of 100 mbps.

Standard electrical connectors, such as modular jacks, punchdown blocks and twenty-five pair miniature ribbon connectors that are used in telephone applications are also suitable for many data communications applications, including Category 3 systems. The use of twenty-five pair cable and connectors for this cable is a common wiring technique and is effective for higher count cable runs, such as between wiring closets. There are however other applications, both in telecommunications applications and in data applications, in which higher count cables, such as twenty-five pair cables, can be effectively employed. For example, a breakout adapter or tap for connecting six (6) four-pair cables directly to a twenty-five pair cable can be useful in many applications.

There are a number of commercially available distribution adapters and distribution box assemblies available for such applications. AMP Incorporated manufactures and sells several distribution adapters, assemblies and boxes of this type. For example, AMP manufactures a Category 3 multi-jack adapter, AMP Part No. 553150-1, that includes two twenty-five pair connectors and five eight position modular jacks. In that adapter, male and female vertical mount twenty-five pair connectors are mounted on a printed circuit board and traces connect individual contacts to corresponding contacts in five vertical mount modular jacks located beside one of the twenty-five pair connectors. Mating twenty-five pair cable connectors can be attached to the printed circuit board mounted twenty-five pair connectors and modular plugs can be mated with the board mounted modular jacks. This adapter is suitable for either a star breakout or for tapping the wires in the twenty-five pair cable. This printed circuit board assembly and the cable connectors are housed in a box having a hinged cover. Since the cable connectors are also positioned in the box, the height of this box (1.922 in) is relatively large, and this adapter is suitable for standalone applications.

AMP Incorporated also manufactures a Category 3 Modular Distribution Box, AMP Part No. 555488-1, that has a lower profile (1.50 in.) in which right angle printed circuit board mounted twenty-five pair connectors are used. In this distribution box the cover includes slots so that mating twenty-five pair cable connectors can be attached to the board mounted twenty-five pair connectors on the side. The commercial version of this device includes two (2) twenty-five pair connectors and twelve (12) vertical mount modular jacks. Depending on the application an adapter of this type could include printed circuit board traces for breaking out four-pair cables from two individual twenty-five pair cables or the traces could connect corresponding positions between the two twenty-five pair board mounted connectors so that the modular jacks would provide a tap.

AMP Incorporated also manufactures and sells Category 3 twenty-five pair modular adapters that comprise a printed circuit board containing a right angle printed circuit board jack and vertical mount six or eight position modular jacks on the printed circuit board, AMP Part Nos. 553867 and 553868.

Although these commercially available adapters, assemblies, and distribution boxes permit taps or breakouts from twenty-five pair cables to four-pair cables or other lower count cables, these prior art devices do not provide sufficient versatility to meet all of the practical applications encountered in typical installations. For example, these breakouts or taps may be required in patch panels, in stand alone applications in which the special housing or boxes provided are suitable, in applications in which the tap or breakout would desirably be housed in other general purpose boxes, such as boxes normally used for power distribution, in undercarpet wiring installations, in plenums, in access floor applications, and in low profile access floor installations such as the POWERFLOR access floors manufactured and sold by Powerflor, Inc. of Charlotte, N.C. and disclosed in U.S. Pat. No. 5,392,571. For example, the overall height of a POWERFLOR pedestal module is 2 ⅝ inches (6.7 cm.). No single distribution box or adapter assembly is suitable for all of these applications, primarily because of the dimensional constraints imposed by these applications. For example, the height and width of these commercially available assemblies are incompatible with low profile access floor applications. The distribution adapter of the present invention, however, is sufficiently versatile to be used in each of these applications. A single configuration will therefore meet all of these needs. The basic invention is also suitable to other applications that may use other standard connector configurations.

Unlike the Category 3 distribution adapters referred to previously, this invention is also suitable for higher speed applications including 100 mbps applications.

SUMMARY OF THE INVENTION

These and other limitations inherent in prior art configurations are overcome by a distribution adapter configuration in which the cable connector for the larger count cable is attached to the top of the distribution adapter and is positioned on the exterior of zone adapter cover.

This distribution adapter includes a printed circuit board subassembly including a printed circuit board, a first multiposition electrical connector for a larger count cable, preferably a twenty-five pair connector, soldered or press fit to the printed circuit board with its mating portion facing upward and one or more second electrical connectors, preferably modular jacks or punchdown blocks, soldered to the printed circuit board beside the first connector, so that wires in smaller count cables extend parallel to the printed circuit board when terminated. The distribution adapter also includes an optional cover mounted on top of this printed circuit board subassembly. The cover includes an opening through which the mating portion of the first multiposition electrical connector is accessible so that it can be mated to a cable connector. In the preferred embodiment, this mating portion extends through this opening so that the mating cable connector remains on the exterior of the cover when mated. In the preferred embodiments, the opening in the cover is located in a channel located between two raised side sections on the top of the thin wall molded cover. These side sections provide clearance for the modular jacks or punchdown blocks located on the sides of the first multiposition connector.

The preferred embodiments of this distribution adapter are specifically intended for use as breakout adapters for twenty-five pair twisted pair cable to four-pair cable in a 100 mbps data distribution network. The first connector is a vertical mount printed circuit board miniature ribbon connector. Right angle printed circuit board modular jacks with the mating end or opening facing laterally outward are used in one embodiment to interface with four-pair cables having eight wire RJ-45 modular plugs attached at the end. In another embodiment 110 style punchdown blocks are used to terminate the wires in the four-pair cable.

BRIEF DESCRIPTION OF THE DRAWINGS

FIG. 3 is a view of the distribution adapter with a low profile cover mounted on the printed circuit board subassembly shown in FIG. 2.

DETAILED DESCRIPTION OF THE PREFERRED EMBODIMENTS

Figure 1:
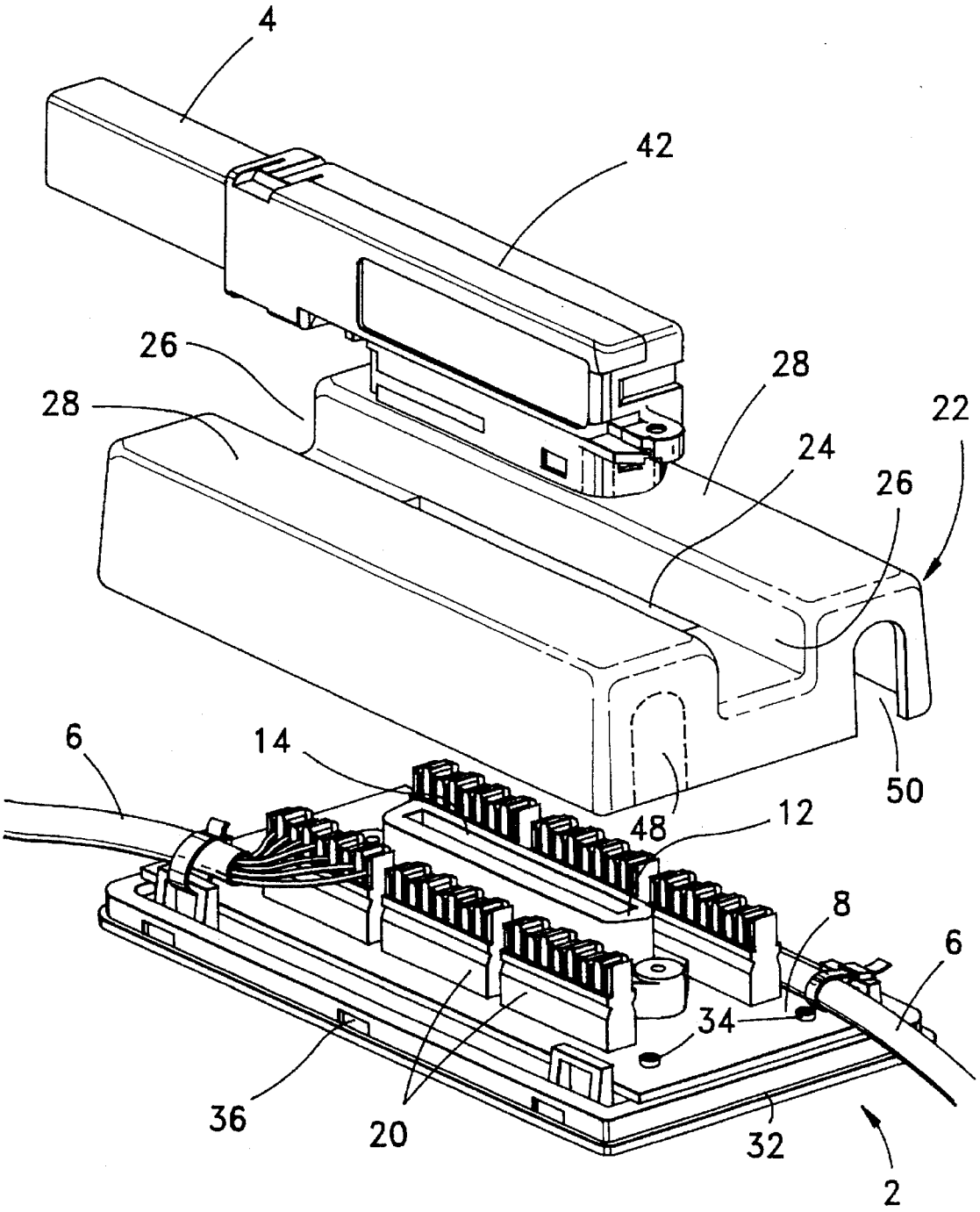
FIG. 1 is an exploded view of an alternate version of the distribution adapter in which a plurality of punchdown blocks are mounted on the printed circuit board.

Two alternate embodiments of a zone distribution adapter 2 for use in connecting corresponding wires in a twenty-five pair cable 4 and a four-pair cable 6 are depicted herein. These two embodiments of the distribution adapter each employ standard electrical connector configurations and are therefore especially useful with standard twenty-five twisted pair cable and four-pair twisted pair cables that are commonly used for telecommunications and data communications. Punchdown blocks 20, often referred to as 110 style blocks, are used in the embodiment of FIG. 1. These punchdown blocks 20 include insulation displacement terminals in a housing to form an insulation displacement termination to the ends of individual wires in a four-pair cable. Standard punchdown tools to force the wires into engagement with the punchdown block terminals are commonly available. The second embodiment of this invention shown in FIGS. 2 and 3 uses a modular jack 16 to interconnect to the four-pair cable 6. Although these standard connectors are logical choices to use in a zone distribution adapter or multi-use outlets of this type, they are not the only electrical connectors that could be employed. For example, AMPBARREL terminals manufactured by AMP Incorporated could be substituted for the punchdown blocks. Other multiposition connectors could be substituted for the twenty-five pair miniature ribbon connector depicted herein could also be employed. This adapter could also be used for applications other than telecommunications or data networks.

Figure 4:
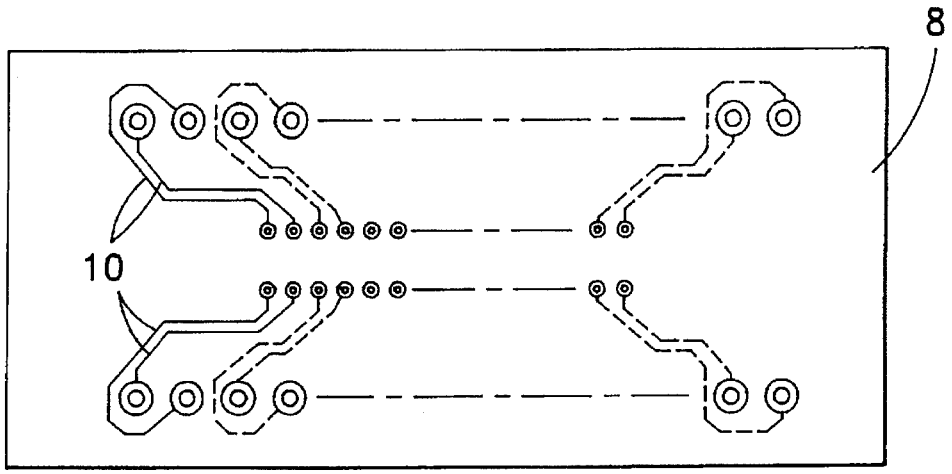
FIG. 4 is a view of a printed circuit board used in the distribution adapter showing the traces connecting corresponding positions in the twenty-five pair board mounted connector and in the four-pair connectors located on each side of the printed circuit board.

The embodiment of the distribution adapter 2 shown in FIG. 1 is intended to be used to connect corresponding wires in a twenty-five pair cable 4 and in a four-pair cable 6 that does not include any connector attached to the end of that cable. This adapter includes a printed circuit board subassembly including a printed circuit board 8, a vertical mount twenty-five pair connector 12 of conventional construction soldered or press fit to the printed circuit board 8 in the center and six (6) eight position punchdown blocks 20 located in two rows of three on each side of the central twenty-five pair connector. Traces 10 join corresponding terminals in the twenty-five pair cable connector 12 and one of the six punchdown blocks 20. These traces 10 are shown in FIG. 4 where traces on the opposite side of the double sided printed circuit board 8 are shown in phantom. The printed circuit board subassembly is mounted on a molded base 32 and is secured to the base by screws 34. A thin wall molded cover 22 is secured to the base by conventional snaps 38 that engage snap grooves 36 on the sides of the base 32.

The vertical mount twenty-five pair electrical connector 12 is of conventional construction, and an AMP CHAMP Vertical Mount PC Board Connector, Part No 554753-1 can be employed. This connector is a receptacle connector and has two rows of contact terminals located on inwardly facing walls on the upwardly facing mating portion 14 of this twenty-five pair connector. Each terminal includes press fit pins extending from the opposite ends of the connector that form a press fit with through holes connected to the traces 10 on the printed circuit board 8. Alternatively pins can be soldered to the traces. Other similar versions of this type of connector can be employed.

The punchdown blocks 20 used in this embodiment are also standard electrical connectors employing eight insulation displacement contacts mounted in a housing. Each contact includes a solder tail on the lower end for soldering the contacts to appropriate traces on the printed circuit board. Lateral slots are molded into the housing on these punchdown blocks and these housing slots are generally aligned with insulation displacement slots on corresponding contacts. An insulated wire, for example a 24 AWG wire, is inserted into these aligned slots and an insulation displacement contact is formed with the wire. The terminated wires extend out the sides of the punchdown blocks generally parallel to the printed circuit board 8. These punchdown blocks are the type commonly used on patch panel assemblies and in other network and telecommunications equipment. For example, these punchdown blocks are of the type commonly used on AMP 110 Connect patch panels, such as AMP Part No. 556796-1. Commercially available tools are used to insert the wires into the slots in these standard connectors. Cable attachment straps 44 are located at the corners of the base 32. A conventional cable tie 46 can then be used to attach exiting four pair cables 6 to the straps 44 to provide a strain relief for the cable to prevent forces applied to the cable from damaging the termination of the individual wire.

Figure 5:
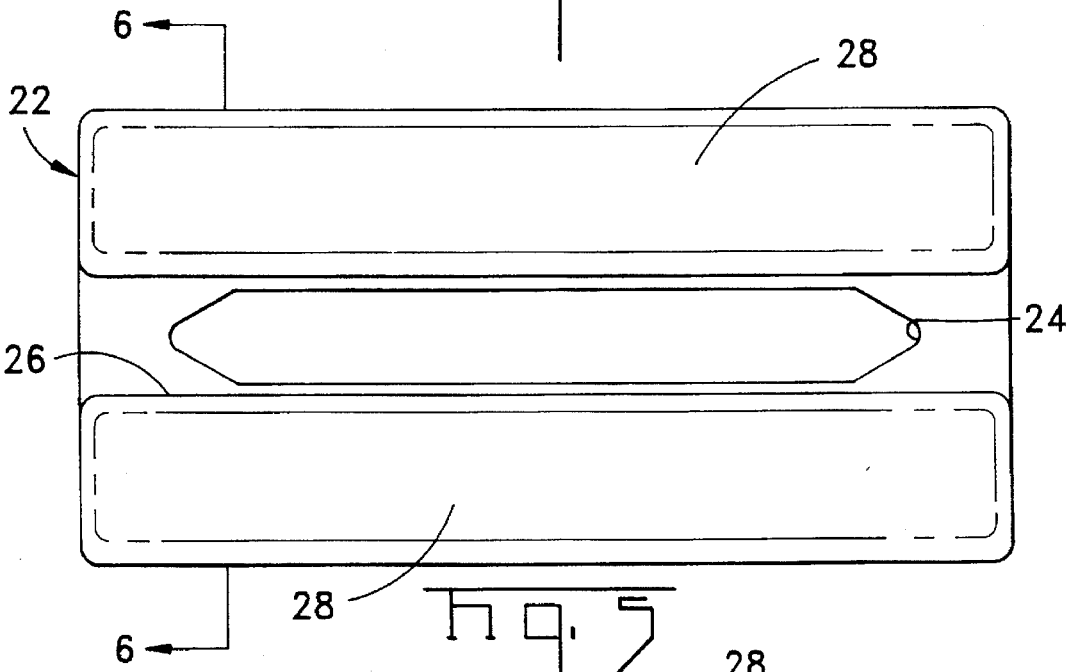
FIG. 5 is a top view of the cover.
Figure 6:
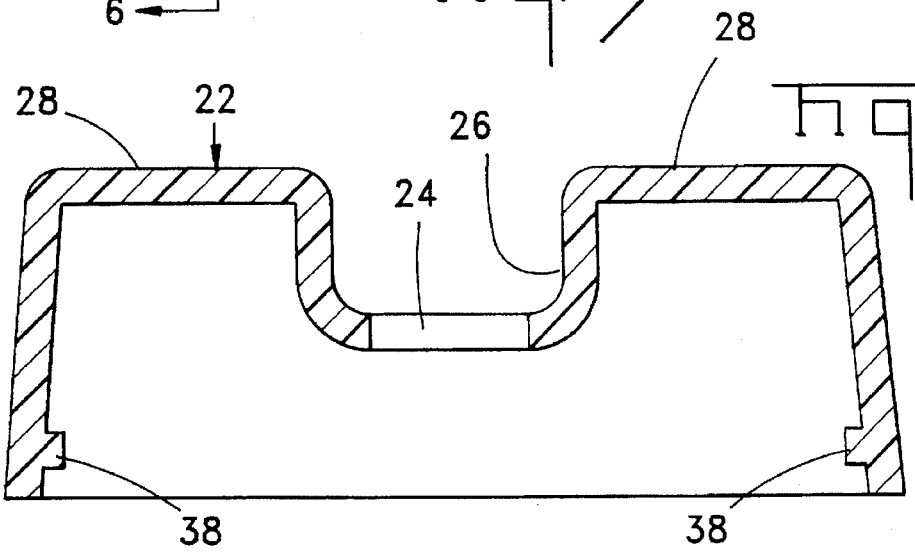
FIG. 6 is a section view taken along section lines 6—6 in FIG. 5.

The molded cover 22 employed with this distribution adapter 2 is snapped to the housing base after the wires in the four-pair cable are terminated to the punchdown blocks 20. This cover is injection molded and has a thin wall. The cover has a central channel 26 extending into the top and a central opening 24 through which the upwardly facing mating portion 14 of twenty-five pair connector 12 is accessible. Central opening 24 extends through the base of channel 26. Two raised side portions 28 extend beside the central channel 26. The height of these raised portions 28 is sufficient to enclose the punchdown blocks 20 when the cover is snapped to the adapter base 32 and the cover 22 also encloses the printed circuit board. In the preferred embodiment, the mating portion 14 of connector 12 extends upwardly through the opening 24 as shown in FIG. 5 and is exposed in channel 26 so that a cable connector plug 42 can be inserted into the channel into engagement with the board mounted connector 12. Cable plug connector 42 is commercially available and in the preferred embodiment an AMP CHAMP system 5 Plug connector, Part No. 558693-1 can be employed. Removable knockout sections 48 are located an each corner of the cover 22. As shown in FIG. 1 these knockouts can be removed to form openings 50 through which the four-pair cables 6 exit the enclosure. These openings 50 are adjacent the location of the cable tie straps 44 so the cable is secured as it exits the housing.

Figure 2:
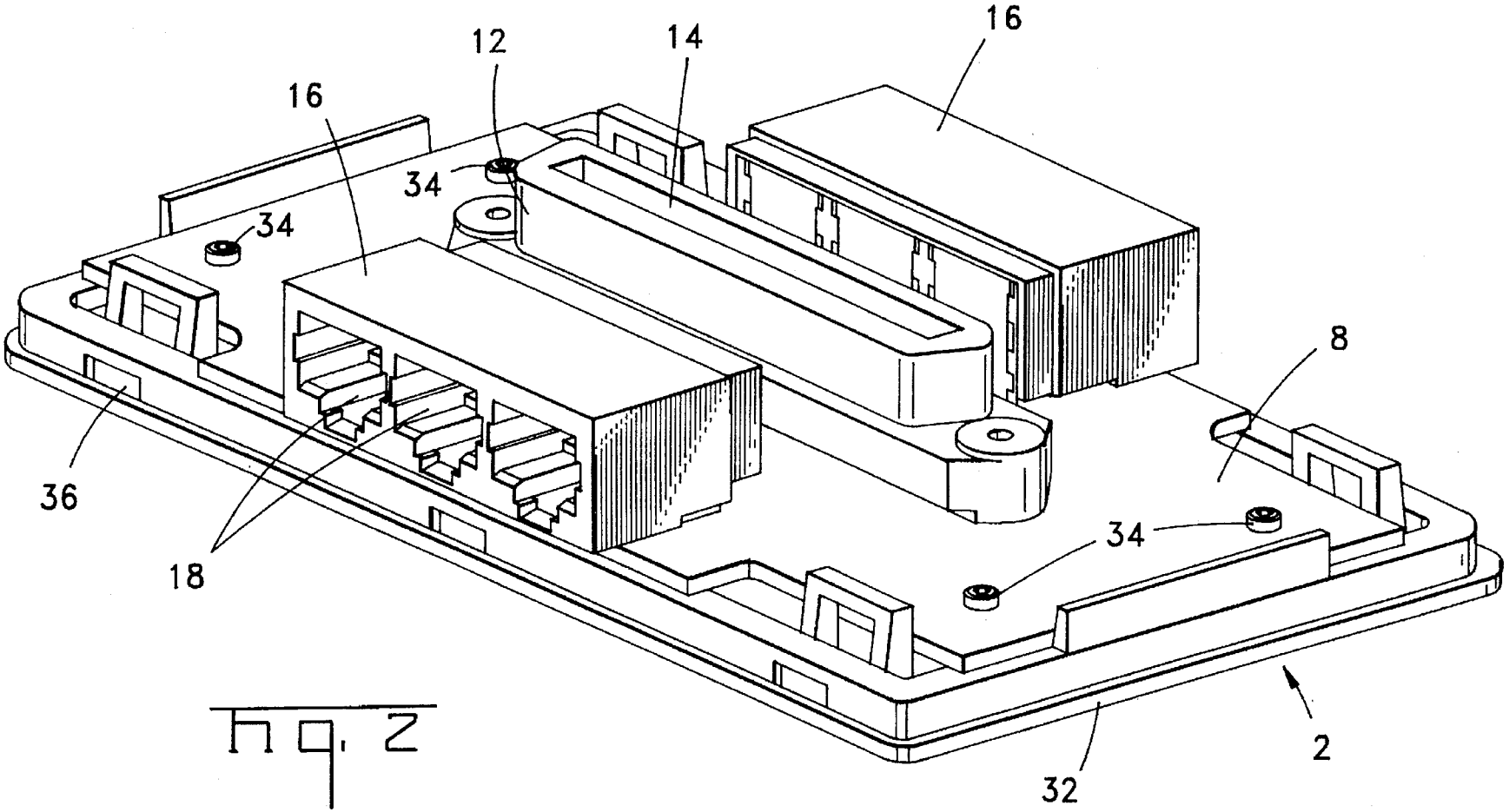
FIG. 2 is a view of a distribution adapter printed circuit board subassembly including a vertical mount twenty-five pair electrical connector receptacle with right angle modular jacks mounted on each side.
Figure 7:
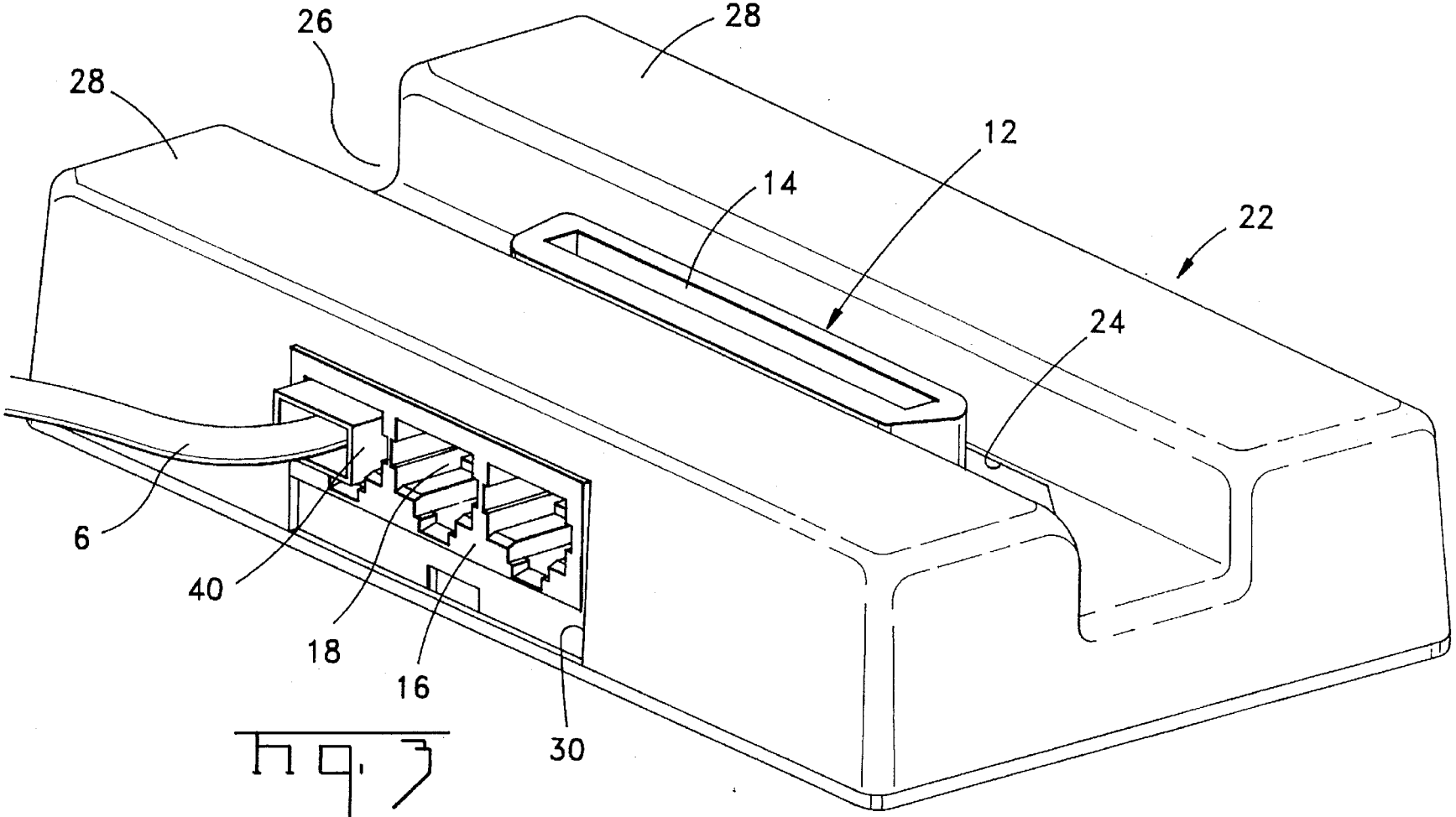

The embodiment of FIGS. 2 and 3 is similar to the embodiment of FIG. 1, but modular jacks 16 of conventional construction are used to connect the four-pair cable to the printed circuit board subassembly. These modular jacks 16 are right angle printed circuit board modular jacks having a mating end or opening 18 that faces to the side relative to the printed circuit board 8. The modular jacks 16 shown in these embodiments are three port modular jacks. More standard individual modular jacks could also be employed. These jacks are mounted on opposite sides of the central twenty-five pair connector 12 that is the same as that shown in FIG. 1. The traces on the printed circuit board 8 would differ from the embodiment of FIG. 1 since the spacing of the modular jack contacts would differ from those in a punchdown block. The cover 22 is similar to that used in the first embodiment, but openings 30 are located on the side of the cover 22 through which the modular jacks are accessible. Standard eight position modular plugs 40 attached to the four-pair cable are inserted into the side facing mating jack openings 18 accessible through these side openings. The side sections 28 are tall enough to envelope the modular jacks and the upwardly facing mating portion 14 of the twenty-five pair vertical mount miniature ribbon electrical connector extends through the central opening 24 as described with respect to the first embodiment.

These distribution adapters 2 represented by the preferred embodiments are more versatile and the final assembly is more compact than the prior art adapters. Since the relatively larger twenty-five pair connector is a vertical mount connector the width of the entire assembly (which includes the mating cable connector) is reduced and the adapters can be employed as a mini-patch panel. The four-pair connectors, such as punchdown blocks 20 and modular jacks 16 can be located on both sides of the central twenty-five pair connector so the length of the printed circuit board can be less. Thus the size of the assembly is reduced making it more suitable for use as a mini-patch panel and making it small enough to fit in some general purpose commercially available utility boxes. Since the cover 22 does not have to enclose the mating cable connector 42 different conventional cable connector mounting accessories, such as strain reliefs, can be accommodated. Furthermore, unlike some prior art configurations, this adapter can easily accommodate both breakout or star configurations at the end of a cable and taps made in the middle of a cable run. A cable connector 42 at the end of the connector can be attached to the upwardly facing printed circuit board connector as illustrated in FIG. 2. Larger back to back assemblies such as AMP Part No. 553257-1 can also be employed for tap configurations. These tap configurations are not possible with prior art unless an additional board mounted connector is included. This exposed vertical mount connectors also permits the use of other configurations, such a twenty-five pair flat cable instead of standard round bundled twenty-five pair cables.

The preferred embodiments of this invention are specifically intended for use as distribution adapters for 100 mbps unshielded twisted pair data networks. These embodiments are also suitable for use in permise telephone systems. Other embodiments that would be suggested to one of ordinary skill in the art could be used in other distribution systems. As already noted a system of this type could be used with ribbon cable or as part of a tap instead of in a star distribution system. For example this distribution adapter could be used in conjunction with IEEE-488-1978 Interface Bus Applications. The invention is also not limited to the use of twenty-five pair and four-pair cables. Other cable configurations could be employed. Other standard connector configurations could also be employed in other embodiments. For example, standard DIN connectors, such as AMP Part No. 745414-1, could be employed instead of a miniature ribbon connector. The specific embodiments depicted herein and the alternative embodiments and applications described or suggested do not include all of the possible uses of this invention that would be apparent to one of ordinary skill and therefore the claims are therefore not limited to the specific embodiments disclosed for representative purposes.

We claim:

1. A distribution adapter for use with first and second cables, each containing individual wires wherein the first cable includes more wires then the second cable, the distribution adapter comprising:

a printed circuit board;

a first multiposition electrical connector mounted on the printed circuit board with a mating portion of the multiposition connector facing upward;

at least one second electrical connector positioned beside the first multiposition electrical connector and arranged so that external conductors of the second cable attached to the at least one second electrical connector extend therefrom parallel to the printed circuit board;

traces on the printed circuit board connecting corresponding positions on the first multiposition electrical connector and on each said at least one second electrical connector, and a cover mounted on top of the printed circuit board, a top of the cover including a central channel and an opening in the central channel through which the upwardly facing mating portion of the first multiposition electrical connector is accessible so that a mating multiposition electrical connector can be attached thereto with the mating multiposition electrical connector remaining on the exterior of the cover, and the cover including raised side portions on each side of the central channel to cover each said at least one second electrical connector;

whereby the first cable having a mating multiposition electrical connector attached thereto is mated to the first multiposition electrical connector and the second cable is terminated to the at least one second electrical connector so that wires in the second cable can be connected to selected wires in the first cable.

2. The distribution adapter of claim 1 further including a base, the printed circuit board and the cover being attached to the base.

3. The distribution adapter of claim 2 wherein the cover is attached to the base by snap fit means located on the cover and the base.

4. The distribution adapter of claim 1 wherein the cover includes side openings through which each said at least one second electrical connector is accessible so that the second cable extends from the side of the distribution adapter when attached thereto.

5. The distribution adapter of claim 1 wherein each said at least one second electrical connector is a printed circuit board mounted modular jack.

6. The distribution adapter of claim 1 wherein each said at least one second electrical connector is a punchdown electrical connector.

7. The distribution adapter of claim 1 wherein the first multiposition electrical connector is a vertical mount printed circuit board electrical connector.

8. The distribution adapter of claim 7 wherein each said at least one second electrical connector is a right angle mounted printed circuit board electrical connect having a mating end facing laterally outward relative to the first multiposition electrical connector.

9. A zone distribution adapter for breaking out four-pair cables from a twenty-five pair distribution cable for multiuser attachment to the twenty-five pair cable, the zone distribution adapter comprising;

a printed circuit board;

a vertical mount twenty-five pair electrical connector mounted on the printed circuit board with a mating portion facing upward;

four-pair electrical connectors positioned beside the twenty-five pair electrical connector, the four-pair electrical connectors being positioned so that four-pair cables attached to the four-pair electrical connectors extend from the four-pair electrical connectors parallel to the printed circuit board and away from the twenty-five pair electrical connector;

traces on the printed circuit board connecting corresponding positions on the twenty-five pair electrical connector and on each four-pair electrical connector, and a low profile cover mounted on top of the printed circuit board, the cover comprising a molded member having first and second side sections protruding above a recessed central channel, and an opening in the central channel through which the upwardly facing mating portion of the twenty-five pair multiposition electrical connector is accessible so that a mating twenty-five pair cable connector can be attached thereto with the mating twenty-five pair cable connector remaining on the exterior of the cover with the cover enclosing the four-pair electrical connectors;

whereby multiple four-pair cables can be attached to the twenty-five pair cable in a low profile enclosure suitable for mounting in a low profile access floor, or a distribution box, or as a patch panel so that the twenty-five pair cable can be used in a data communications network to connect the zone distribution adapter with a central distribution source.

10. The zone distribution adapter of claim 9 wherein the four-pair electrical connectors comprise right angle modular jacks, each jack having an outwardly facing mating end aligned with a removable section on a side of the cover so that the mating end of the modular jack is accessible from the side.

11. The zone distribution adapter of claim 9 wherein the four-pair electrical connectors comprise punchdown blocks located beside the twenty-five pair electrical connector.

12. A distribution adapter for use with first and second twisted pair cables wherein the first cable includes more twisted pair wires then the second twisted pair cable, the distribution adapter comprising:

a printed circuit board;

a vertical mount miniature ribbon connector mounted on the printed circuit board with a mating portion of the vertical mount miniature ribbon connector facing upward;

at least one second electrical connector positioned beside the vertical mount miniature ribbon connector and arranged so that external conductors of the second twisted pair cable attached to the at least one second electrical connector extend therefrom parallel to the printed circuit board;

traces on the printed circuit board connecting corresponding positions on the vertical mount miniature ribbon connector and on each said at least one second electrical connector; and a cover mounted on top of the printed circuit board, the cover having raised side sections and central channel, an opening in the central channel through which the mating portion of the vertical mount miniature ribbon connector extends so that the mating miniature ribbon connector attached to the first twisted pair cable is located on the exterior of the cover when connected to the vertical mount miniature ribbon connector, the raised side sections of the cover providing clearance for each said at least one second electrical connector, the raised side sections having side openings each in alignment with a respective said at least one second electrical connector so that the external conductors of the second twisted pair cable extend from the side of the distribution adapter.

13. The distribution adapter of claim 12 wherein a said at least one second electrical connector is mounted on each side of the vertical mount miniature ribbon connector so that a said second twisted pair cable can be connected on each side of the distribution adapter.

14. The distribution adapter of claim 13 wherein multiple said at least one second electrical connectors are mounted on each side of the vertical mount miniature ribbon connector.

15. The distribution adapter of claim 14 wherein the multiple second electrical connectors comprise right angle printed circuit board mounted modular jacks.

16. The distribution adapter of claim 14 wherein the multiple second electrical connector comprise punch down electrical connectors.

17. The distribution adapter of claim 16 wherein the punch down electrical connectors comprise punchdown blocks.

* * * * *